United States Patent [19]

Hansen et al.

[11] Patent Number: 4,752,070

[45] Date of Patent: Jun. 21, 1988

[54] TEACHING AID DEVICE FOR RACKET SPORTS

[76] Inventors: George B. Hansen; George I. Hansen, both of 530 Sage St., Lake Geneva, Wis. 53147

[21] Appl. No.: 814,658

[22] Filed: Dec. 30, 1985

Related U.S. Application Data

[63] Continuation-in-part of Ser. No. 465,114, Feb. 9, 1983, abandoned.

[51] Int. Cl.[4] ..... A63B 49/04

[52] U.S. Cl. ..... 273/29 A; 273/163 R

[58] Field of Search ..... 273/26 B, 29 A, 80 A, 273/163 R, 163 A, 167 F, 194 A, 194 B; 272/119

[56] References Cited

U.S. PATENT DOCUMENTS

| | | | |
|---|---|---|---|
| Des. 111855 | 10/1938 | Moreno | 273/163 R |
| 2,608,409 | 8/1952 | Pinkerton | 273/26 B |
| 3,667,761 | 6/1972 | Palotsee | 273/186 A |
| 3,693,973 | 9/1972 | Wattenburg | 273/73 R |
| 3,709,490 | 1/1973 | Pruss | 273/29 A |
| 3,937,465 | 2/1976 | Roland | 273/29 A |
| 4,002,343 | 1/1977 | Eckert | 273/163 R |
| 4,045,034 | 8/1977 | Thomas | 273/194 B |
| 4,108,433 | 8/1978 | Althoff | 273/29 A |
| 4,142,721 | 3/1979 | Faleck et al. | 273/73 R |
| 4,163,552 | 8/1979 | Tiso | 273/29 A |
| 4,183,526 | 1/1980 | Brown | 273/29 A |
| 4,200,285 | 4/1980 | Petitti, Jr. | 273/29 A |
| 4,327,908 | 5/1982 | James | 272/119 |
| 4,445,686 | 5/1984 | Daugherty | 273/29 A |
| 4,588,191 | 5/1986 | Stewart | 273/194 B |

FOREIGN PATENT DOCUMENTS 2299049 10/1974 France .

OTHER PUBLICATIONS

Vic Braden and Bill Bruns, entitled "Vic Braden's Tennis for the Future", dated 1977.

Peter Burwash, entitled "Tennis for Life", pp. 81-83.

*Primary Examiner*—Richard C. Pinkham

*Assistant Examiner*—T. Brown

*Attorney, Agent, or Firm*—Willian Brinks Olds Hofer Gilson & Lione Ltd.

[57] ABSTRACT

A racket sport teaching aid device comprises a frame that includes a pointing member. Unexpectedly good results are achieved when a weight is attached to the lower end of the frame. The weighted frame physically maintains the face of the racket perpendicular to the plane of the ground at both the back swing and at the ball impact point. The weighted frame serves the triple functions of stabilizing the head of the racket at the time of impacting the ball, of maintaining the head of the racket at a proper angle with respect to the ground, and of providing a directional guide to be visually observed by the player. This helps the player both to remember to maintain the racket head at impact at a proper angle with respect to the ground and actually physically assists the player in performing this task. The device also assists the player in following through on the stroke such that the follow-through is up and in the direction of the intended shot. The device accomplishes this effect because the pointing member serves as a visual guide which points to the intended target point at completion of the stroke.

15 Claims, 3 Drawing Sheets

FIG. 1
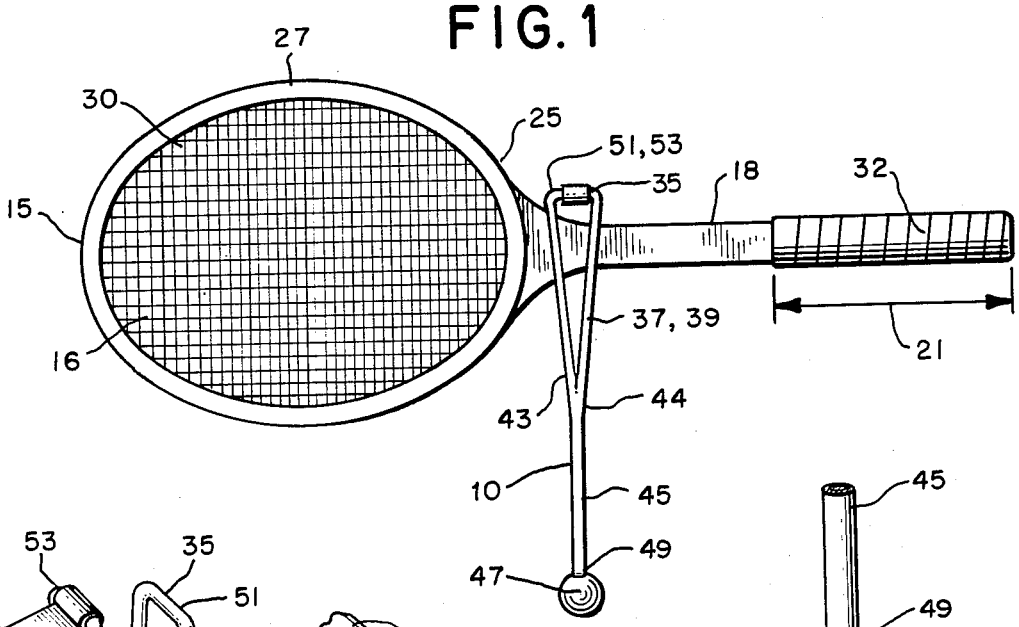
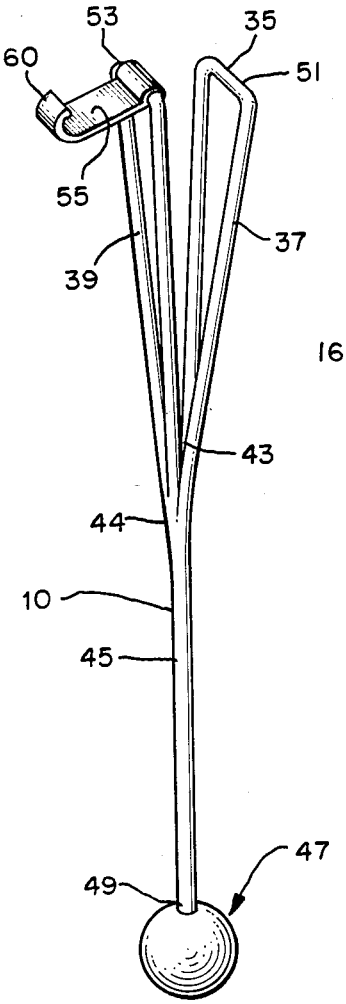
FIG. 2
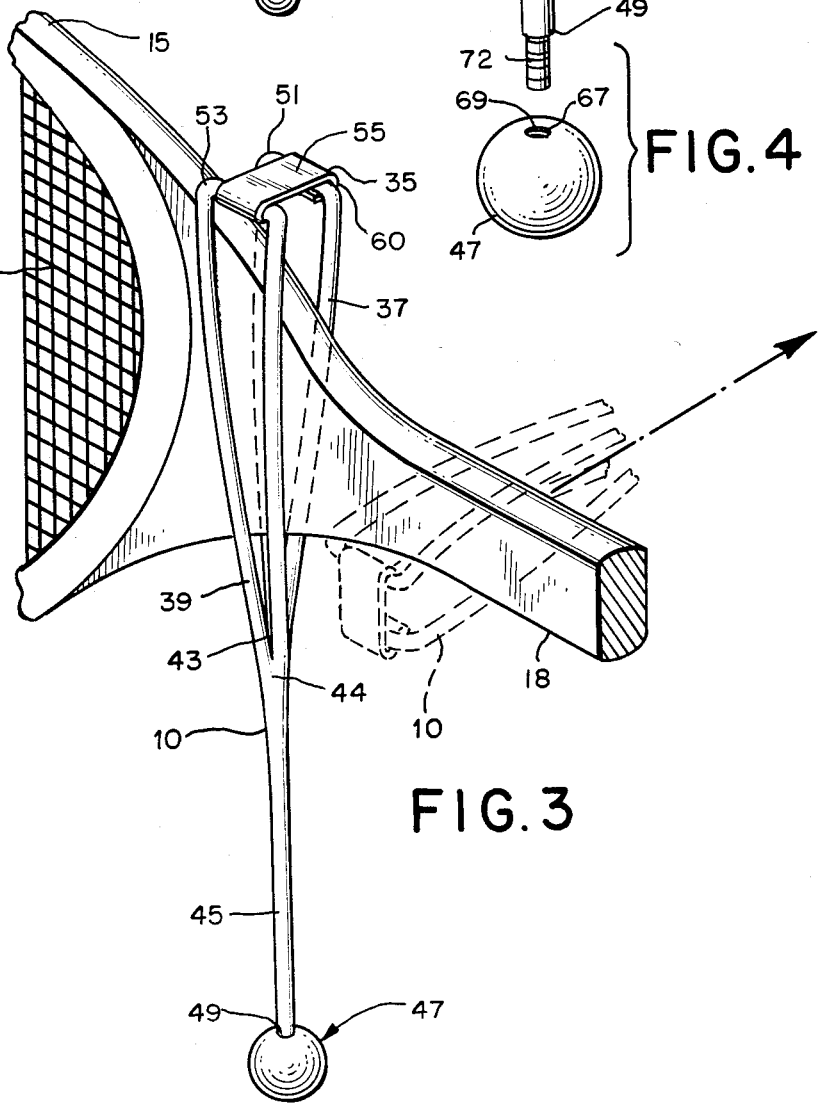
FIG. 3
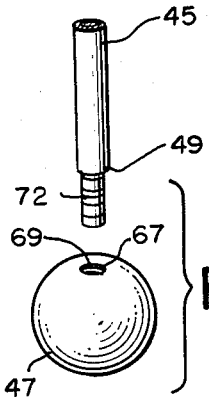
FIG. 4

P
B
10
15
16
45

TEACHING AID DEVICE FOR RACKET SPORTS

CROSS REFERENCE TO RELATED APPLICATIONS

This application is a continuation-in-part application of earlier filed U.S. patent application Ser. No. 06/465,114, filed Feb. 9, 1983 (now abandoned).

BACKGROUND OF THE INVENTION

This invention relates to a new and useful teaching aid device for sports played with rackets. Specifically, the invention relates to teaching players of racket sports to maintain the head of the racket at an optimum angle when impacting a ball while playing a racket sport, as well as teaching the proper direction of the follow-through after the time of impacting the ball. The invention also stabilizes the head of the racket when impacting a ball. The invention is especially useful in teaching tennis.

It is well known that the successful enjoyment of and optimal playing characteristics of various types of racket sports such as tennis, racketball, paddleball and squash are dependent upon the proper stroking of the racket by the player so as to maintain proper control over the ball. Moreover, in games played with rackets, certain parameters are critical in order to achieve proper control in operation of the racket. In particular, the angle of the racket face at the time the racket impacts the ball and the proper direction of the follow-through of the stroke after the ball is impacted are extremely important. Typically, the best results are achieved when during impact with the ball, the racket face is at an angle which is perpendicular to the ground or the floor of the court on which the game is being played. Often, the poorly hit ball is a result of a racket being maintained at an undesirable angle at the time of impact. Similarly, a proper follow-through is essential to a consistent stroke and a proper ball control. Many players are unable to master these problems and beginners typically require considerable time to develop the proper control of the impact angle of the racket and the proper follow-through.

In many racket sports it is also desirable to maintain the shaft of the racket substantially parallel to the ground at the time of the impact with the ball or at a specific angle with respect to the ground. Again, many players are unable to maintain the proper angle between the shaft and the ground.

Since the various racket sports, and in particular the game of tennis, have become very popular sports and recreational pastimes, many technical articles and books have been written by professionals with regard to improvements in the game of tennis or in other racket sports. However, these articles and books are effective only to the extent that they teach the tennis player proper movement and control of a racket, in literary form. These literary articles suffer from the very substantial disadvantage that they do not physically aid the player once the player or trainee is actually physically engaged in a game or a training exercise.

For example, one of the problems involved in the training of a tennis player is that the tennis player may have read such literary articles and, in fact, may have been instructed by a trainer. However, the instructions obtained from these articles or the trainer are often of limited value when the trainee attempts to actually practice the techniques which are taught by the literary articles or instructors. The trainee in the game of tennis often experiences great difficulty in achieving the necessary stroking movement and maintaining the proper racket face angle which would aid in the ability to play the game of tennis by such trainee.

Some of these difficulties are due to the fact that many variables must simultaneously be considered by the player in order to effect a proper stroke. Among these variables are the angle of the racket face with respect to the ground, the angle of the shaft of the racket with respect to the ground, the direction of the follow-through, the speed of the stroke or swing of the racket, and the trajectory of the stroke. It is difficult for the new player to concentrate on so many different variables which must be executed in a successful stroke. This is especially true with respect to literary articles or to verbal instructions communicated from a teacher since in attempting to execute the proper stroke successfully the player must consider each of these variables at the same time.

The problem with the prior art verbal and written teaching aids stems from the fact that the player must consider these verbal or written instructions as to the proper form of the stroke and at the same time, physically implement the written or verbal instructions without any tangible assistance.

Attempts have been made to overcome the problems associated with teaching tennis by providing tennis stroke training devices. For example, U.S. Pat. No. 3,693,973 (Wattenburg), discloses a device which is both strapped to the player's forearm and attached onto the grip portion of the tennis racket. The device is intended to assist players in keeping their wrists as rigid and straight as possible. See, e.g., column 1, lines 7–20 of the Wattenburg patent. This device is cumbersome to use and it does not address the essential problem of teaching how to hit the ball at a correct impact angle and with a proper follow-through.

U.S. Pat. No. 3,937,465 (Roland) discloses a training device which assists the trainee in stroking a tennis racket such that the head of the racket does not dip below the wrist of the trainee. The device includes a harness which is secured to the body of the trainee and a cord which extends from the harness to the racket. Again, this device is cumbersome to use and, as the Wattenburg patent, it does not address the essential problem of teaching how to hit the ball at a correct impact angle and with a proper follow-through.

U.S. Pat. Nos. 4,108,433 (Althoff), 4,142,721 (Faleck et al.), 4,200,285 (Petitti Jr.) disclose the use of weights on tennis and other rackets but, again, these devices do not address the problem of teaching how to hit the ball at a correct impact angle and with a proper follow-through. Specifically, the device disclosed in the Althoff patent is a warm-up device designed to add weight to the racket head in advance of actual play. See column 1, lines 5–25. The Faleck et al. patent discloses a weight and belt assembly which may be strapped on a tennis racket primarily to modify the balance of the racket but also as a training device. See column 1, lines 58–62 and column 2, lines 5–9. The use of the device for training is in keeping "the attention of the player focused on the plane of his swing and on the ball." See column 3, lines 52–56. The Petitti patent discloses an exercise and training device which includes two weights that can be attached to the rim on the head of a racket. See FIG. 1.

The present invention overcomes problems inherent in the prior art by providing a device which helps the player to focus on a single task of observing the direction of a pointer associated with the device. The weight of the device automatically physically assists the player to maintain the face of the racket at a proper angle at the time of the impact with the ball and stabilizes the racket at the time of the impact of the ball, as well as to maintain the proper direction of the follow-through. In addition, the device functions as a visual reinforcement which reminds the player to keep the racket face at a proper angle and to maintain the proper follow-through.

Thus, one object of the present invention is to provide a teaching aid device which assists a trainee in stroking a ball with a racket such that at impact the racket is at an optimum angle and the racket's follow-through is along the optimum path.

Another object of the present invention is to provide a teaching aid device which improves a player's strokes by allowing the player to concentrate on one visual spot—the direction of the pointer of the device. Yet another object of the invention is to automatically physically assist the player to maintain the racket in the desired position at impact and to maintain the proper direction of the follow-through.

Still another object of the present invention is to provide a tennis teaching aid device which stabilizes the racket upon impact and therefore improves the effectiveness of off-center shots.

A further object of the present invention is to provide a teaching aid device for racket sports, which once secured to the racket, will not slip or fly off regardless of how hard one hits the ball with the racket.

Another object of the invention is to provide a device which may be used in conjunction with different weights so as to take into account the different physical limitations of various players.

A still further object of the invention is to provide a teaching aid device for racket sports which requires no alteration to and does not damage the racket.

Still another object of the present invention is to provide a teaching aid device for racket sports which does not have to be worn on or attached to the player's body and which therefore does not restrict the player's movements and is not cumbersome to use.

Yet another object of the invention is to provide a device which serves as a teaching aid for racket sports, which is useful with all styles and forms of rackets.

Other objects of the present invention will occur to those skilled in the art upon studying this disclosure.

BRIEF DESCRIPTION OF THE DRAWINGS

FIG. 1 is a front elevational view of a conventional tennis racket having a first embodiment of a teaching aid device constructed in accordance with the present invention secured to the shaft thereof;

FIG. 2 is a perspective view of the first embodiment of a teaching aid device constructed in accordance with the present invention;

FIG. 3 is a partial perspective view of the racket and teaching aid device of FIG. 2 shown selectively positioned on a racket;

FIG. 4 is a partial perspective view of the weight portion of the teaching aid device of FIG. 2 with the weight disattached from the device;

SUMMARY OF THE INVENTION

Figures 5A, 5B, 5C, 6A, 6B, 6C, 7:
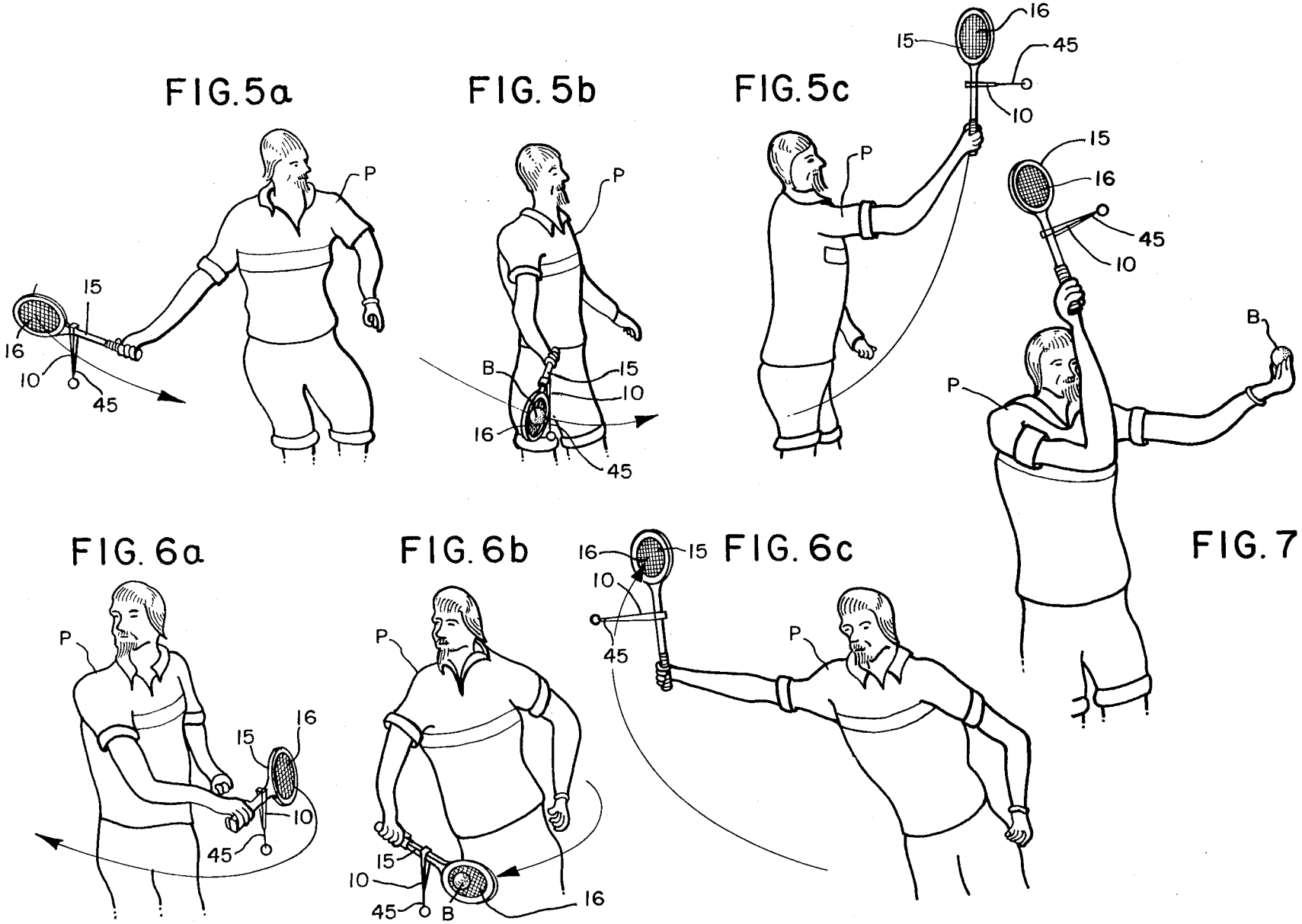
FIGS. 5*a*, 5*b* and 5*c* are a perspective sequential view of a typical forehand tennis stroke with the racket equipped with the device of FIG. 2.
FIGS. 6*a*, 6*b* and 6*c* are a perspective sequential view of a typical backhand tennis stroke with a racket equipped with the device of FIG. 2.
FIG. 7 is a perspective view of a typical beginner's serve motion executed with a tennis racket equipped with the device of FIG. 2.

The present invention provides a device which facilitates teaching players of racket sports, and particularly tennis players, to hit a ball with a racket at a proper impact angle and with the proper follow through. These purposes are effected by allowing the player to concentrate on a single task of observing the direction of a pointer of the device, by physically aiding the player in keeping the racket at a proper angle at impact and by stabilizing the racket head at impact.

In one embodiment, the device comprises a frame which includes a pointer. The frame is attached to the shaft of a racket. Unexpectedly good results are achieved when the lower end of the frame is weighted. In another form of the invention, the device comprises a weighted pointer which is attached to the annular rim of a racket. The weighted pointer has an upper portion and a lower portion. The lower portion is of a generally inverted triangular-shape and forms a pointer. The upper portion includes attachment means and is adapted to secure the device to the racket such that the pointer extends in the plane formed by the racket face and in a direction substantially perpendicular to the line formed by the shaft portion of the racket.

The weight of the device physically maintains the face of the racket perpendicular to the plane of the ground at both the back swing and at the ball impact point. The weighted frame serves the triple functions of stabilizing the head of the racket at the time of impacting the ball, of maintaining the head of the racket at a proper angle with respect to the ground, and of providing a directional guide to be visually observed by the player. This helps the player to remember to maintain the racket head at a proper angle with respect to the ground at the time of impact with the ball and actually physically assists the player in performing this task. The device also assists the player in following-through on the stroke such that the follow-through is up and in the direction of the intended shot with a rising trajectory. The device accomplishes this effect because the weighted frame serves as a visual guide which allows the player to know he/she has made a proper follow-through if and when the device points out across the net at the completion of the stroke. To execute a proper stroke, the player focuses on the task of having the pointer point to the intended target point at the completion of the stroke.

DETAILED DESCRIPTION OF THE INVENTION

Unexpectedly, it has been discovered that a device that attaches to a racket can significantly aid in teaching players a proper execution of a stroke including maintaining a proper racket angle during impact with the ball and a desired follow-through. The device of the present invention includes a frame with a pointing member. The frame is attached anywhere on a racket but generally either on the annular rim of the racket head or between the head of the racket and the handle thereof, preferably on the shaft of the racket, near or on the throat thereof. The pointing member allows the player to focus on keeping the racket at a predetermined position with respect to the ground at impact and at the completion of the stroke. It has been found that if the racket position is proper at impact and the completion of the stroke, it is generally also proper throughout the stroke. The pointer makes the player generally aware of the position of the racket. Unexpectedly good results are achieved when the frame is weighted. The weight can be due solely to the weight of the frame or it can be attached preferably at the point on the frame farthest away from the racket shaft. Additional advantages result in having the attached weight removably mounted so that it can be replaced by weights of different sizes depending on the player or removed altogether for some strokes, such as volley. The weighted frame tends to maintain the racket at the desired position when striking the ball on ground strokes; therefore, it physically assists the player in the task of keeping the racket at a proper position. The weight also stabilizes the racket head at impact which increases the effectiveness of "off-center" shots.

It should be noted that the device of the present invention can be used not only in teaching ground strokes but also in teaching volleys and serves. Some of the functions of the present invention are, however, not utilized when teaching these other strokes. For example, when the device of the present invention is used to teach volleys and serves, its main function is that the pointer points to the intended target during and at the completion of the stroke and that it makes the player aware of the position of the racket and of the racket face. However, the weight of the device does not function to physically and automatically help the player to maintain the proper angle of either the racket face or the racket shaft with respect to the ground.

It should also be noted that two angles are of critical importance in hitting a ball with a racket. The most important, especially in tennis ground strokes, is the angle of the racket face with respect to the ground. It has been shown that consistent strokes are produced when the racket face is generally perpendicular to the ground at impact with the ball. Therefore, this approach of hitting the ball is recommended for all but advanced players. Advanced players may choose to hit the ball with the racket face at an angle other than 90 degrees with respect to the ground. Such strokes are, however, more difficult to execute. However, the present invention can be used for teaching hitting a ball with the racket face at an angle other than 90 degrees with respect to the ground as well. The direction of the pointer can be adjusted, if necessary, when teaching these strokes.

The second angle which is of importance in many racket sports is the angle of the racket shaft with respect to the ground. For example, the current trend is to teach tennis and squash players to hit the ball while the shaft of the racket is substantially parallel to the ground. The present invention assists the player to maintain the shaft at a desired angle with respect to the ground by providing a visual reference point and a physical weight.

As used herein, the term "angle" can include depending on context either or both the angle of the racket face with respect to the ground or the angle of the shaft of the racket with respect to the ground.

The teaching aid device of the present invention can be used in connection with any racket sport in which the impact angle and the follow-through are important; however, it is especially useful in connection with teaching tennis. The use of and the construction device embodying the present invention will be illustrated in connection with a preferred embodiment of the device used in connection with tennis rackets.

Referring now to the drawing, and specifically to FIG. 1, a teaching aid device constructed in accordance with the present invention is generally designated by a numeral 10. The device 10 is secured to a conventional tennis racket 15. The racket 15 has an elongated shaft portion 18 which at one end integrally merges into a handle portion 21 and which at the opposed end integrally merges into a head portion 25. The head portion 25 is substantially elliptical in configuration and is provided with an annular rim 27 supporting a quadrilaterally located arrangement of strings 30 forming a net. The string net defines a racket face 16 which is designed to engage a ball (not shown in FIG. 1). The handle portion 21 is provided with a conventional grip 32 on the outer end of thereof. The grip 32 is adapted to be grasped by the player.

As shown in FIGS. 1–3 and particularly in FIG. 3, the teaching aid device 10 of the present invention comprises a frame 35 which has a pair of inverted triangular-shaped prongs 37 and 39 which join together at their apexes 43 and integrally merge into the upper end 44 of a rod 45 which extends downward in a generally vertical direction. A spherically-shaped weight 47 is attached to the lower end 49 of the rod. Each inverted triangular prong 37 and 39 has an upper base 51 and 53 respectively which are parallel to each other. A hinged clamp 55 is rotatably mounted to the upper 53 base of one of the inverted triangular prongs 39.

The frame including the pair of inverted triangular prongs 37 and 39 and the downwardly extending rod 45 are preferably made of spring steel which is preferably completely coated with a vinyl or rubber composition which prevents corrosion of the teaching aid as well as prevents scraping the racket when the teaching aid device 10 is connected thereto. The spring steel permits the opposed prongs to be squeezed together to hold the device 10 by frictional force on the racket 15. In order to increase the frictional forces and to further protect the racket from being damaged by the device 10, a sleeve (not shown) may be provided to fit on the racket shaft 18 between the shaft 18 and the prongs 37, 39 and the clamp 55 of the device 10.

The hinged clamp 55 is rotatably mounted on the upper base 53 of one of the inverted triangular prongs 39. The clamp 55 can be made of any suitable material but is preferably made of steel. The unhinged end 60 of the clamp 55 has a curved configuration which functions to accommodate the upper base 51 of the inverted triangular prong 37 which is unhinged.

A weight 47 is connected to the lower end 49 of the rod 45. The weight 47 is preferably in the form of a spherical ball fabricated of a lead-tin alloy or other appropriate heavy metal. The weight 65 may be connected in any number of ways. In the preferred embodiment shown in the drawings, the weight 47 is removably threaded to the lower end 49 of the rod 45. As shown in FIG. 4, the weight 47 includes a cylindrical bore 67 which contains circular threads 69 so as to engage the threads 72 on the lower end 49 of the rod 45. This arrangement permits substituting weights of various weight so as to accommodate the teaching aid to persons of different physical limitations and capabilities.

The teaching aid device 10 is secured to the shaft portion 18 of the racket 15 by placing the shaft portion 18 of the racket 15 between the opposed prongs 37, 39 so as to position the shaft portion 18 below the upper bases 51, 53 and above the apexes 43 of the prongs 37, 39. The prongs 37, 39 are then manually squeezed together so that the hinged clamp 55 can be secured to the unhinged upper base 51 such that the shaft 18 of the racket 15 is locked into position firmly between the opposed prongs 37, 39 and is seated snugly therebetween. The shaft portion 18 does not slip and is not damaged or scratched because of the vinyl or rubber composition which completely covers the prongs. This prevents the teaching aid device 10 from sliding up or down the shaft 18 in a longitudinal direction. An additional protection of the shaft portion 18 and a more secure mounting is effected by inclusion of the sleeve (not shown). See FIG. 3.

The use of the device 10 of the present invention will now be illustrated in connection with several tennis strokes depicted in the drawings. Referring now specifically to FIGS. 5–6, the teaching aid device 10 of the present invention enables a player P to swing the racket 15 to hit ground strokes—either forehand strokes as shown by FIG. 5 or backhand strokes as shown by FIG. 6—while maintaining the face 16 of the racket head portion 25 at the desirable angle to the ground. When the player P hits ground strokes with the racket 15 the weight of the teaching aid device 10 will stabilize the racket head 25. The weight of the device 10 helps the player P both to remember to keep the racket face 16 perpendicular to the ground and also helps the player P to actually perform this talk. After impacting a ball B, the player P then follows-through on the stroke to a point where the rod 45 points to the intended target. As a result, the face 16 of the racket 15 is maintained at the proper position relative to the ground during the impact of the ball B and at the completion of the stroke. After impacting the ball B the player follows-through on the stroke of the racket 15 and the training aid device 10 has the added important advantage that the follow-through stroke is done at a rising trajectory which starts from a lower elevation and ends at a higher elevation. The device of the present invention is highly effective in maintaining the face 16 of the racket at an optimum angle both during the backward and forward swing of the racket.

Turning now to FIGS. **5*a* and 6*a*, the player P takes the racket 15 back to the starting point of the forward stroke in preparation for impacting a ball. At the starting point of a stroke—either for a forehand stroke as shown in FIG. 5*a* or for a backhand stroke as shown in FIG. 6*a*—the rod 45 of the device 10 points downward in a generally vertical direction so that the racket face 16 of the racket 15** is maintained perpendicular to the ground. The player P then puts the stroke into a forward motion.

Referring specifically to FIGS. **5*b* and 6*b* the forehand stroke or the backhand stroke respectively result in the racket face 16 of the racket engaging and impacting a ball B. The rod 45 of the device 10 of the present invention points downward in a generally vertical direction so that the face 16 of the racket 15 is perpendicular to the ground. The weight of the device 10 helps the player P to remember to keep the face 16 perpendicular to the ground and also helps the player P to actually perform this task. The weight of the device 10 also stabilizes the racket 15** as the time of the impact of the ball B.

After impacting the ball B, the player P then follows-through on the forehand stroke of the racket 15 as shown in FIG. **5*c* or on the backhand stroke of the racket 15 as shown in FIG. 6*c*, as the case may be. At the end of the follow-through of the stroke the rod 45 of the device 10 points generally in the direction of the intended target. The player P need only focus on the rod 45 of the device 10 and observe that the rod 45 points in the direction of the intended target. The device 10** also has the added important advantage that the follow-through stroke is done at a rising trajectory which starts from a lower elevation and ends at a higher elevation.

As shown in FIG. 7, the device 10 is also useful in teaching a tennis service. FIG. 7 shows a player P preparing to serve a ball B. To serve as a useful aid in teaching a tennis service the device 10 of the present invention is secured to the racket 15 so that the rod 45 of the device 10 points in a direction perpendicular to the racket face 16. As shown in FIG. 7 the rod 45 of the device then points generally in the direction of the intended target during the impact of the ball B when making a tennis service. The device therefore has the important advantage of making the player P aware of the position of the racket 15 and of the racket face 16.

It is clear from the description above that the teaching aid device 10 does not physically restrain the movement of the player and is easy and quick to install on and remove from the racket. The teaching aid device does not interfere with the playing of the game.

Figure 8:
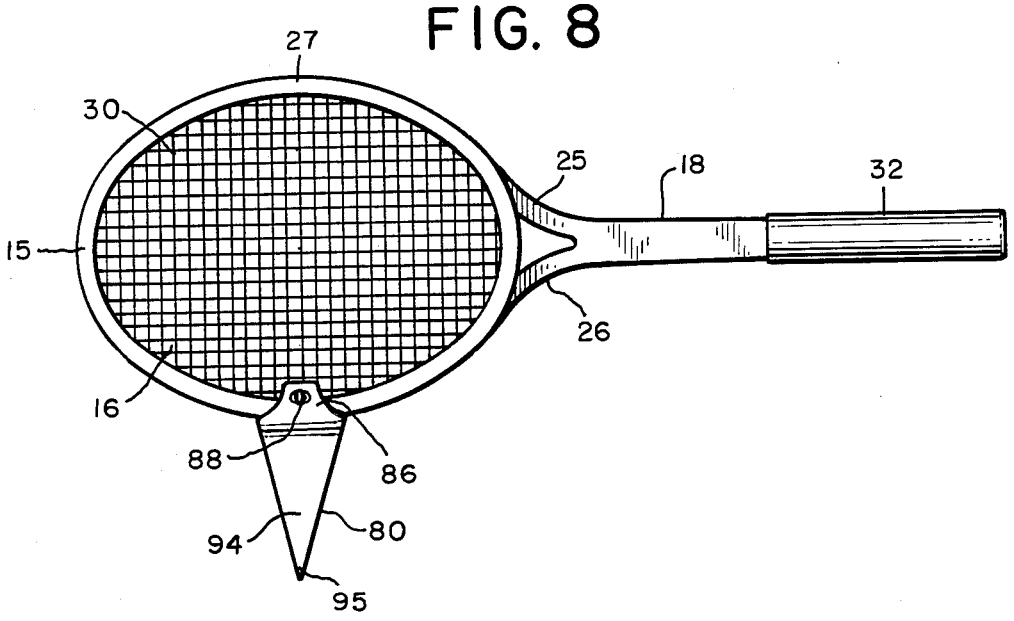
FIG. 8 is a front elevational view of a conventional tennis racket having a second embodiment of a teaching aid device constructed in accordance with the present invention secured to the annular rim thereof.
Figure 9:
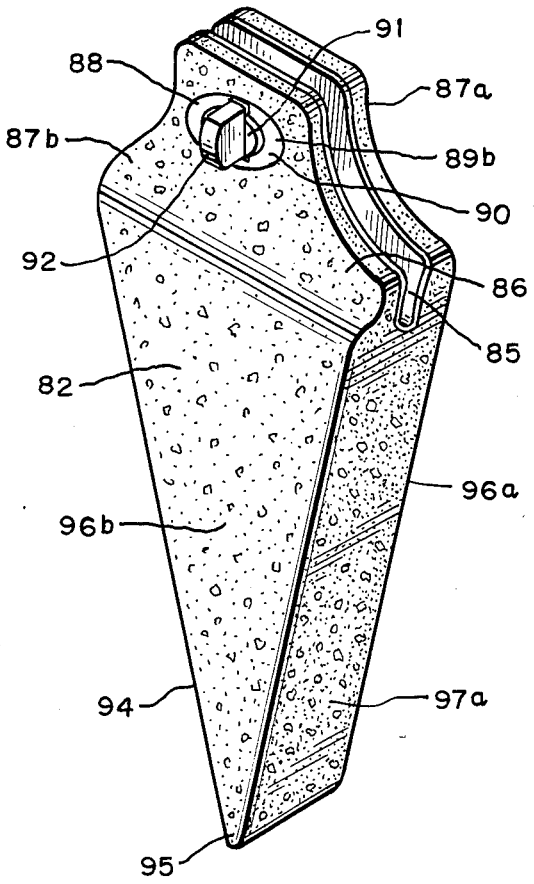
FIG. 9 is a perspective view of the second embodiment of a teaching aid device constructed in accordance with the present invention.

FIGS. 8–9 illustrate another embodiment of a teaching aid device constructed in accordance with the present invention generally designated by the numeral 80. The device 80 is secured to the annular rim 27 of a conventional tennis racket 15. Preferably, the device 80 is secured to the low portion of the annular rim 27 such that the pointer of the device 80 will extend in the plane formed by the racket face 16 and in a direction substantially perpendicular to the line formed by the shaft portion 18 of the racket 15.

As shown in FIGS. 8–9 and particularly in FIG. 9, the teaching aid device 80 comprises a frame 82 formed of a resilient sponge-like material such as vinyl foam or polyurethane foam. While any such material is suitable, it has been found that a commercially available material known as "BEVALITE", available from Boyd Corporation, 2306 Merced Street, San Leandro, Calif., is particularly useful for this purpose. It is very resistant to tearing, is durable and has good wear characteristics. In addition, the material is sufficiently rigid such that the frame formed thereof maintains its shape during use. It also has sufficient weight to automatically physically assist a player to execute a proper stroke. In this exemplary embodiment, the device 80 has a weight of about 50 grams.

The frame 82 has an upper portion 86 and a lower portion 94. The upper portion 86 includes a pair of flippers 87*a* and 87*b* which include an attachment means 88 adapted to secure the device 80 to the annular rim 27 of the racket 15. The lower portion 94 of the frame 82 is of a generally inverted triangular-shape and forms a pointer 95.

As shown in FIG. 9, the lower portion 94 of the frame 82 includes a pair of opposed parallel inverted triangular-shaped faces 96*a* and 96*b* joined by a pair of generally rectangular shaped faces 97*a* and 97*b*. The thickness of the pointer, that is, the width of the rectangular faces 97*a* and 97*b*, is preferably between $1\frac{3}{8}$ inches and $1\frac{1}{2}$ inches. The width of the upper base portion of each inverted triangular-shaped face 96*a*, 96*b* is preferably between 3 inches and $3\frac{3}{4}$ inches while the length of the pointer, that is, the height of each inverted triangular-shaped face 96*a*, 96*b*, is preferably between 6 inches and 7 inches.

Any suitable arrangement for removably attaching the device 80 to the annular rim 27 of the racket may be utilized. By way of illustration, and not limitation, the attachment means 88 shown in the exemplary embodiment of FIGS. 8–9, comprises a turnbuckle system having a screw portion 89*a* and a receptacle portion 89*b*. While any suitable attachment system may be used, it has been found that a commercially available system known as "COMMON SENSE," available from TRW, Atlanta Distribution Sales Center, 4508 Bibb Boulevard, Tucker, Ga., is particularly useful for this purpose. Screw portion 89*a* is mounted in an aperture formed in flipper 87*a* and receptacle portion 89*b* is mounted in an aperture formed in flipper 87*b*. Receptacle portion 89*b* includes a metal ring 90. Screw portion 89*a* includes a shank 91 adapted to fit through the metal ring 90. Shank 91 includes a tip swivel portion 92 which is rotatably mounted thereon such that when screw portion 89*a* and receptacle portion 89*b* are coupled together by inserting shank 91 through ring 90, the tip swivel 92 may be rotated 90 degrees thereby securing metal ring 90 to shank 91. The shank 91 and swivel 92 are dimensioned to fit through the string net of racket face 16 and has sufficient length so that flippers 87*a* and 87*b* may be pulled together. The teaching aid device 80 is secured to the annular rim 27 of the racket 15 between the opposed interior faces of flippers 87*a* and 87*b* so as to position the pointer 95 in a direction substantially perpendicular to the line formed by the shaft portion 18 of the racket 15. The screw portion 89*a* of flipper 87*a* is inserted through receptacle portion 89*b* of flipper 87*b* and then swivel 92 is rotated 90 degrees thereby securing the device 80 to the racket 15 and in particular, the annular rim 27 thereof. In such fashion, the annular rim 27 is thereby locked into position between flippers 87*a* and 87*b*.

Flippers 87*a* and 87*b* form a channel for inserting the annular rim 27 of the head portion 25 of the racket 15 therebetween. The interior face of each flipper is lined with a sleeve 85 formed of vinyl or rubber composition which prevents tearing or wearing out of the teaching aid, and as well provides for a more secure attachment of the device to the racket. The vinyl or rubber composition sleeve 85 also increases the frictional force between the device, particularly the flippers, and the annular rim 27 of the racket 15 thereby providing a more secure mounting of the same. The sleeve 85 prevents the annular rim 27 from slipping, and as well from being damaged or scratched by the metal fastening system 88. It also prevents the device 80 from sliding along the annular rim 27.

Figure 10:
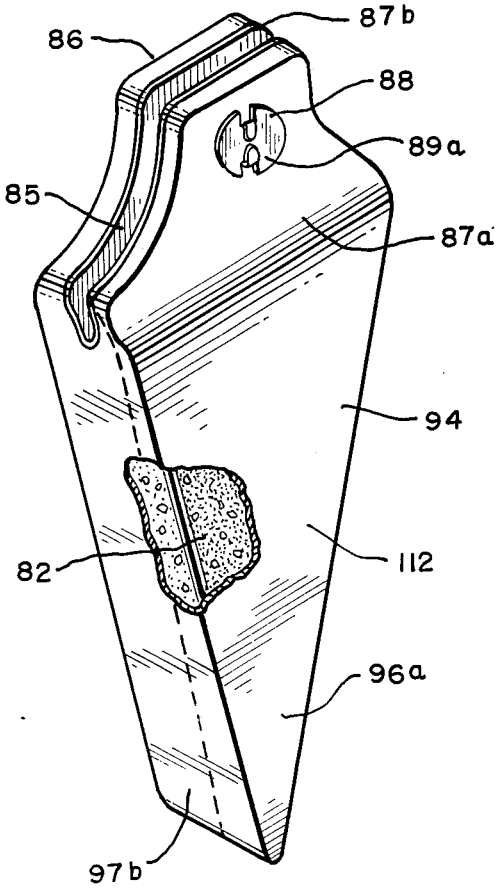
FIG. 10 is a perspective view of a third embodiment of a teaching aid device constructed in accordance with the present invention which includes a fabric cover.

FIG. 10 illustrates another embodiment of a teaching aid device constructed in accordance with the present invention generally designated by the numeral 110. In the embodiment shown in FIG. 10, the same reference numerals are used as in FIGS. 8–9 to designate corresponding parts which will not be described again as to their structure or function. The device 110 is very similar to the embodiment illustrated in FIGS. 8 and 9, but includes a fabric cover 112 utilized to enclose the frame 82 formed of a resilient sponge-like material. The fabric cover 112 may be formed of any suitable material including, by way of example and not limitation, vinyl, canvas or nylon. The use of a fabric cover for the frame is advantageous inasmuch as it it is lightweight and water repellent. It also enhances the durability of the device.

The use of the device 80 shown in FIGS. 8–9, and/or the use the device 110 as shown in FIG. 10, is substantially the same as shown in FIGS. 5–7. The device, however, is secured to the annular rim 27 of the head portion 25 of the racket 15 rather than the shaft portion 18. The operation and function of the device remains the same.

The teaching aid device of the present invention enables a player P to swing the racket 15 to hit ground strokes—either forehand strokes or backhand strokes—while maintaining the face 16 of the racket head portion 25 at the desirable angle to the ground. The teaching aid device 80 and/or the device 110 is secured to the midway portion of the racket face 16, as shown in FIG. 8, for use in teaching ground strokes—either forehand strokes or backhand strokes. The operation and use of the teaching and device shown in FIGS. 8–10 is substantially the same as described for the device of FIGS. 1–4 with reference to FIGS. 5 and 6 and will not be repeated. At the end of the follow-through of the stroke, the pointer 95 points out in a forward direction across the net in the direction of the intended target. The device has the important advantage of allowing the player to concentrate on a single task of observing the direction of the pointer 95 at the completion of a stroke. A player knows that he/she has completed a proper stroke when the pointer 95 points in the direction of the intended target at the completion of the stroke. In addition, the weight of the device automatically physically assists the player to maintain the face 16 of the racket 15 at a proper angle at the time of impact with the ball and stabilizes the racket at the time of impact with the ball; it also automatically helps the player to maintain the proper direction and trajectory of the follow-through. The player knows that when the pointer 95 points out across the net a correct follow-through has been made. When the player concentrates on executing a stroke such that the pointer 95 points out across the net, the desirable results of a straight up and down bevel at impact, a straight-ahead swing, and a low to high swing are accomplished.

The device 80 (or 110) is also useful for teaching a tennis serve. For use in teaching serves, the device 80 (or 110) is secured to the racket 15 in the same position as for ground strokes. See FIG. 8. For topspin serves, the player concentrates on hitting the ball B when the pointer 95 of the device 80 (or 110) is pointing skyward. The resulting motion (low to high) produces a topspin serve. For slice serves, the player concentrates on hitting the ball B when the pointer 95 of the device 80 points to the right (to the right of a straight ahead position for a right-handed player). The result is that a sidespin is produced on the ball B, and hence a slice serve.

In addition, the device 80 (or 110) is useful in teaching volleys. For volleys, the device 80 (or 110) is taken off the racket head area and attached near the yoke area 26 of a conventional tennis racket 15, see FIG. 8, so that the pointer 95 of the device 80 (or 110) points perpendicular to the plane of the racket face 16. The player then practices by having the pointer 95 point forewards during forehand volley strokes and backwards during backhand volley strokes.

It is clear from the description above that the teaching aid devices 80, 110 do not physically restrain the movement of the player and are easy and quick to install on and remove from the racket. The teaching aid devices do not interfere with the playing of the game.

Many changes and modifications will occur to those skilled in the art upon studying this disclosure. All such changes and modifications which fall within the spirit of the invention are intended to be included within its scope as defined by the appended claims.

We claim:

1. A teaching aid device for games played with rackets having a shaft, one end of which is connected to a head portion which is capable of engaging a ball and the other end of which is connected to a handle portion which is capable of being grasped by a player, said teaching aid comprising:

a frame having an upper portion and a lower portion, said lower portion being of a generally triangular shape to form a pointed end, said upper portion comprising a pair of spaced apart side members, each of said side members being joined at one end thereof to said lower portion such that said upper portion of said frame is substantially coplanar with said lower portion, said pair of side members forming a channel for receiving a portion of a racket therebetween; and means for securing said upper portion of said frame to a portion of a racket such that said pointed end points in the direction of the intended target at the completion of a properly executed stroke and allows the player to focus thereon in order to keep the racket face in the desired position.

2. The teaching aid device claimed in claim 1 wherein, said means for securing includes a fastening element adapted to connect said pair of side members to one another such that said portion of the racket is located in said channel and between said fastening element and said pointing member.

3. The teaching aid device claimed in claim 2 wherein said frame includes weighting means capable of physically assisting in keeping the racket in a desired position and stabilizing it upon impact.

4. The teaching aid device claimed in claim 1 wherein said lower portion has a length of substantially between about 6 inches and 7 inches.

5. The teaching aid device claimed in claim 4 wherein said lower portion has a thickness of substantially between about $1\frac{3}{8}$ inches and $1\frac{1}{2}$ inches.

6. The teaching aid device claimed in claim 5 wherein said securing means comprises a turnbuckle system.

7. The teaching aid device claimed in claim 1 wherein said racket is a tennis racket.

8. The teaching aid device claimed in claim 1 wherein said racket is a squash racket.

9. The teaching aid device claimed in claim 1 wherein said racket is a racketball racket.

10. The teaching aid device claimed in claim 1 wherein said racket is a paddleball racket.

11. A tennis teaching aid device comprising:

a weighted frame comprising first and second inverted substantially triangular-shaped face portions each of which is substantially between about 6 inches and 7 inches in length, each of said first and second inverted triangular-shaped face portions having an upper end and a lower apex; and, means for attaching said upper ends to a tennis racket such that each of said lower apexes of said first and second inverted triangular-shaped face portions point in a direction substantially parallel to the face of the tennis racket, said weighted frame substantially automatically physically assisting a player to maintain the face of the tennis racket at a proper impact angle and to maintain the proper direction of the follow-through during a tennis stroke, said means for attaching comprising a first and a second side member, said first side member being joined at one end to said upper end of said first inverted triangular-shaped face portion and said second side member being joined at one end to said upper end of said second inverted triangular-shaped face portion such that each said side member is substantially coplanar with said associated inverted triangular-shaped face portion, and a fastening element to join said first and second side members together such that a portion of the tennis racket is positioned in between said side members and such that said portion of the racket is disposed below said fastening element and is disposed above said upper ends of said first and second inverted triangular-shaped face portions.

12. A teaching aid device for tennis which assists in maintaining the face of a tennis racket at a desired orientation throughout the stroke including at impact and at completion of the stroke, said tennis aid device comprising:

a frame made of a resilient sponge-like material, said frame having an upper portion and a lower portion, said lower portion having a generally inverted triangular-shape which forms a pointer, said lower portion comprising a pair of opposed parallel inverted triangular faces each having an upper base of substantially between about 3 and $3\frac{3}{4}$ inches and a height of substantially between about 6 and 7 inches, said pair of opposed parallel inverted triangular faces joined by a pair of generally rectangular shaped faces each having a width of substantially between about $1\frac{3}{8}$ and $1\frac{1}{2}$ inches, said upper portion including a pair of flippers which form a channel for inserting an annular rim of a head portion of a tennis racket therebetween and wherein the interior face of each flipper is lined with a sleeve; and, means for attaching said upper portion of said frame to the head portion of said tennis racket such that said pointer points in a direction substantially parallel to the face of the racket, said means for attaching comprising a metal fastening system mounted to said flippers.

13. The teaching aid device claimed in claim 12 further comprising a fabric cover which encloses the frame.

14. The teaching aid device claimed in claim 12 wherein said material is vinyl foam.

15. The teaching aid device claimed in claim 12 wherein said material is polyurethane foam.

* * * * *